US008893885B2

(12) United States Patent
Hutchens

(10) Patent No.: US 8,893,885 B2
(45) Date of Patent: Nov. 25, 2014

(54) TOOL STORAGE SYSTEM

(76) Inventor: Sean Hutchens, Cardiff, CA (US)

( * ) Notice: Subject to any disclaimer, the term of this patent is extended or adjusted under 35 U.S.C. 154(b) by 356 days.

(21) Appl. No.: 13/177,207

(22) Filed: Jul. 6, 2011

(65) Prior Publication Data

US 2012/0175277 A1 Jul. 12, 2012

Related U.S. Application Data

(63) Continuation-in-part of application No. 12/883,462, filed on Sep. 16, 2010, now abandoned.

(51) Int. Cl.

| | |
|---|---|
| ***B65D 85/28*** | (2006.01) |
| ***G09F 23/00*** | (2006.01) |
| ***B25H 3/02*** | (2006.01) |
| ***B25H 3/04*** | (2006.01) |

(52) U.S. Cl.

CPC *G09F 23/00* (2013.01); *B25H 3/02* (2013.01); *B25H 3/04* (2013.01)

USPC ..... 206/373; 206/459.5; 206/565

(58) Field of Classification Search

USPC ..... 206/372, 373, 349, 459.5, 565, 560

See application file for complete search history.

(56) References Cited

U.S. PATENT DOCUMENTS

| | | | | |
|---|---|---|---|---|
| 3,878,939 | A * | 4/1975 | Wilcox | 206/373 |
| 4,736,843 | A * | 4/1988 | Leonard | 206/369 |
| 5,114,007 | A * | 5/1992 | Chen | 206/373 |
| 5,320,223 | A * | 6/1994 | Allen | 206/372 |
| 5,394,983 | A * | 3/1995 | Latulippe et al. | 206/370 |
| 5,711,428 | A * | 1/1998 | Ho | 206/738 |
| 5,725,096 | A * | 3/1998 | Winnard | 206/350 |
| 7,410,053 | B2 * | 8/2008 | Bowen et al. | 206/373 |
| 7,530,459 | B2 * | 5/2009 | Yeh | 206/372 |
| 2003/0203138 | A1 * | 10/2003 | Gargus | 428/34.2 |
| 2009/0020447 | A1 * | 1/2009 | Potterfield et al. | 206/373 |

* cited by examiner

*Primary Examiner* — Jacob K Ackun

(57) ABSTRACT

Specialized tool storage boxes may be produced by defining an inventory of tools to be stored in the box. The tools may be positioned in proposed desired locations. Shadows of the tools in their respective desired locations may be produced. Image of the shadows may be produced on an insert for the tool storage box. The insert may be placed in the box so that the tools can be replaced in the desired locations after being removed from the box.

7 Claims, 2 Drawing Sheets

TOOL STORAGE SYSTEM

RELATED APPLICATIONS

This application is a Continuation-in-Part of U.S. patent application Ser. No. 12/883,462 filed Sep. 16, 2010 now abandoned.

BACKGROUND OF THE INVENTION

The present invention generally relates to storage units for sets of tools that may be associated with a particular task. For example, maintenance of a particular type of vehicle may be efficiently performed if a tool set is established and organized so that all required maintenance tools are readily accessible. For such a system to be effective, the tools need to be replaced to particular locations in a dedicated storage system after each use. Proper storage of the tools may result in ready availability for successive usage.

As can be seen, there is a need for a tool storage system which can easily be employed by a user to replace tools in their proper storage location. Additionally there is a need for such a system to be adaptable to numerous variations of tool sets.

SUMMARY OF THE INVENTION

In one aspect of the present invention, a storage system for a set of tools may comprise: a box; an insert board having a tool-contact side and an image side opposite the tool contact side; and images of the tools formed on the image side of the board, the insert board being oriented in the box so that the image side of the board faces an underside of the box and so that tools placed in the box contact the tool-contact sides of the board.

In another aspect of the present invention, an insert for a tool storage box may comprise: a sheet of material having a tool-contact side and an image side, opposite the tool-contact side, and having images of tools in their respective desired locations on the image side.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide tool storage boxes and a method for producing tool storage boxes in which a graphic indicator of tool location is embedded in the box. In exemplary embodiments of the invention a desired collection of tools, for inclusion in a box, may be placed in a desired location. Images of shadows of the tools may be produced on an insert for the box in which the tools are to be stored.

Figure 1:
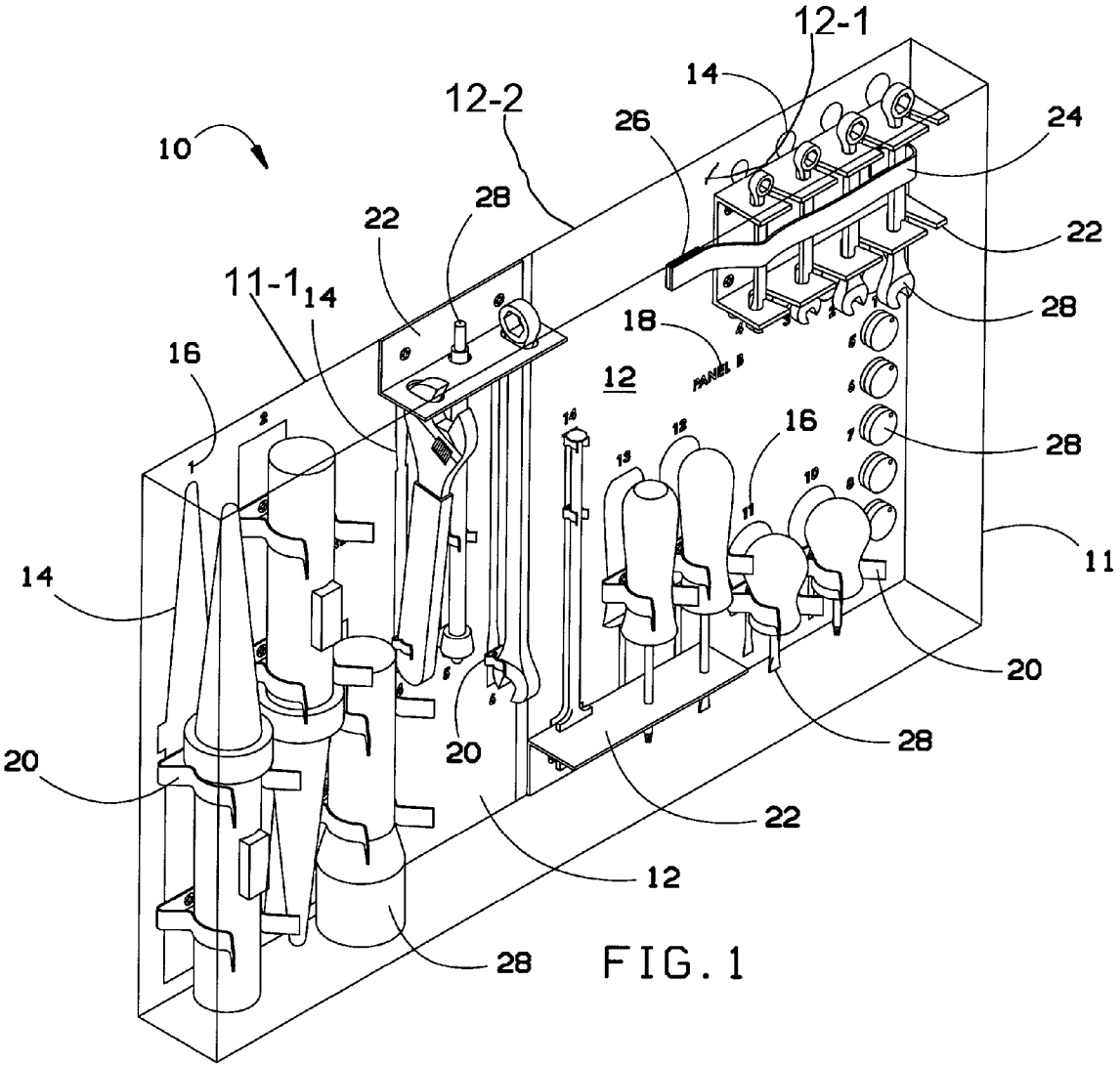
FIG. 1 is a perspective view of an assembled tool storage box in accordance with an embodiment of the invention.
Figure 2:
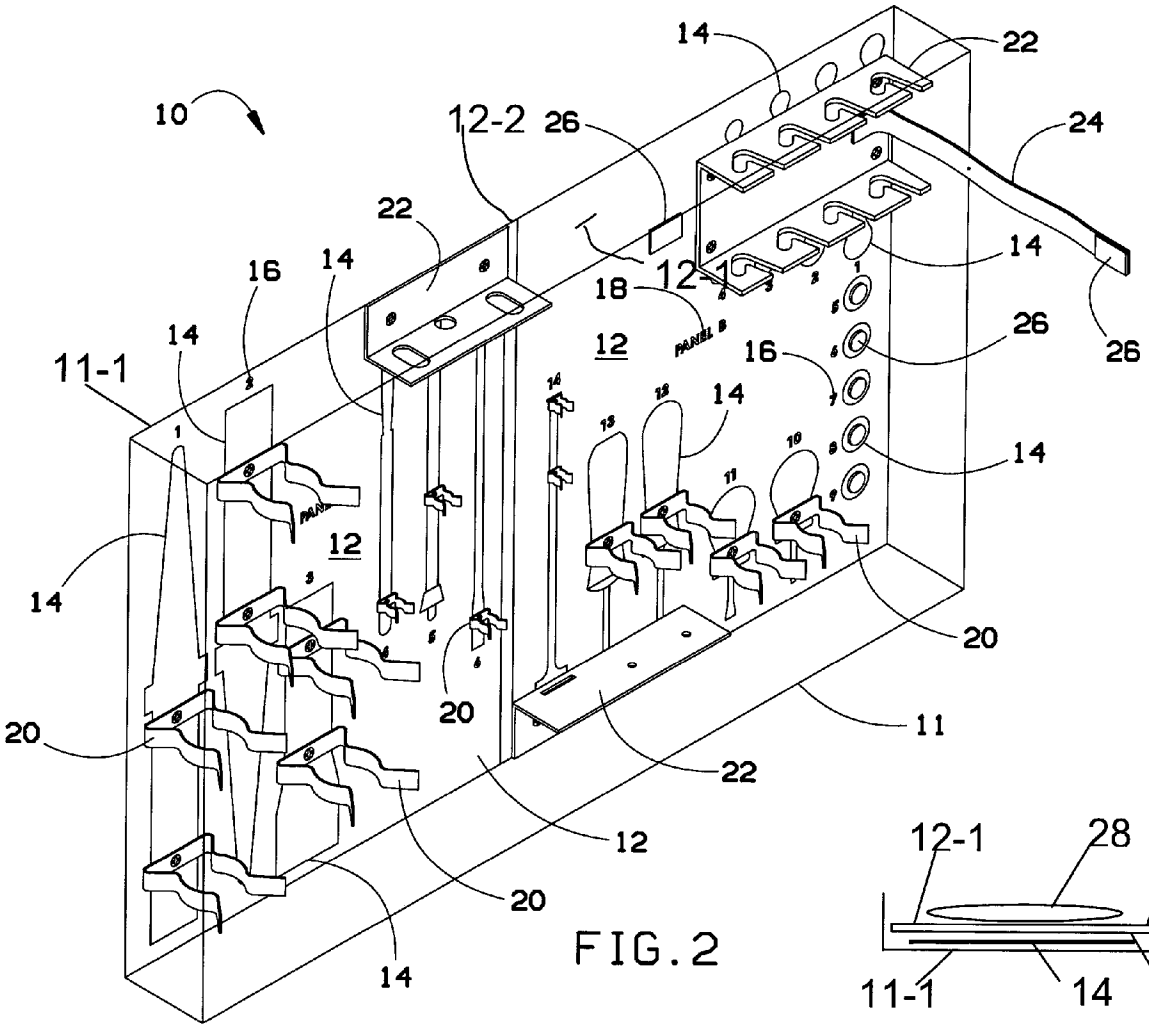
FIG. 2 is a perspective view of an insert of the tool storage box of FIG. 1.

Referring now to FIG. 1, a tool storage insert 10 is illustrated with attached tools 28. The tool storage insert 10 may be a portion of a dedicated storage box 11 which may be readily accessible on or near a vehicle (not shown) such as a specialized military vehicle (e.g., an aircraft, a tank or a truck). The insert 10 may comprise an insert board 12 and various tool holders such as spring clips 20, a tool bracket 22; a strap 24 and hook and loop fasteners 26.

Figure 3:
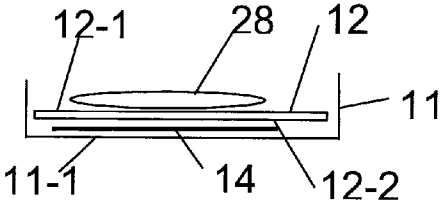
FIG. 3 is a schematic sectional view of a portion of the tool storage box of FIG. 1.

Referring now to FIG. 3, it may be seen that the insert board 12 may be transparent or translucent and may have a tool-contact side 12-1 and an opposing image side 12-2. On its image side 12-2, the insert board 12 may be printed with outlines, silouetttes or images of tools (collectively referred to herein as tool images 14) and tool numbers 16. Panel text 18 may also be included. Collectively, the tool images 14, numbers 16 and text 18 may be printed on the image side 12-2 of the insert board 12. A user of the tools 28 may readily determine the proper location for each of the tools after each use by looking at the images 14 and/or the numbers 16 and text 18, The user may also confirm that all of the tools 28 have been returned to the box 11 after completion of a task, thus assuring that none of the tools have been left inside a vehicle on which repairs have been performed. Missing tools can be readily identified by their respective empty outline and associated number 16

In an exemplary embodiment, the insert board 12 may comprise a sheet of polycarbonate having a thickness of about 0.10 inch. The board 12 may be oriented so that its image side 12-2 may face toward an underside 11-1 of the box 11 while the tool-contact side 12-1 may face upwardly and away from the underside 11-1 of the box 11. It may be noted that the tools 28 may not come into contact with the images 14 because the images may be printed on a side opposite the tool contact side 12-1. In other words, the board 12 may positioned to intervene between the tools 28 and the images 14 of the tools. Consequently, the images 14 may be protected from abrasion that might otherwise arise from repeated removal and replacement of the tools 28 in the box 11. Thus the images 14 may remain readily visible to a user even after repeated use of the tools 28.

In an exemplary method for producing one or more of the tool boxes 11 the following steps may be performed. In a first step, a customer may define an overall size for the box 11 and an inventory of tools 28 to be stored in the box 11 and the types of required tool holding devices 20, 22, 24 and/or 26. In a second step, the customer or a fabricator of the box 11 may arrange the tools 28 and holding devices in a layout on a sheet of photosensitive material. In a third step, a shadow-like image of the layout may be made. In a fourth step, a printing mask may be produced. In a fifth step, images 14 of the tools 28 may be produced on the insert 12 using a conventional image production technique, (e.g., by reverse screen printing or laser scribing). Finally, the tool holding devices may be attached to the printed insert board 12 and the box 11 may be assembled (e.g., by adhesively attaching the insert board 12 in the box 11).

In optional steps, multiple sets of the tools may be delivered to a fabricator. The fabricator may produce numerous boxes and install tools into each box so that complete packaged tool sets may be delivered to a customer.

While the foregoing has been described in the context of a box 11 employing an insert board 12 on top of the underside

11-1, another exemplary embodiment may comprise a translucent board 12 whose rear face is the box underside 11-1 and the images 14 are printed or etched within the board 12 between the underside 11-1 and the tool contact side 12-1.]

It should be understood, of course, that the foregoing relates to exemplary embodiments of the invention and that modifications may be made without departing from the spirit and scope of the invention as set forth in the following claims.

I claim:

1. A storage system for a set of tools consisting of:

a box;

a sheet of polycarbonate configured as a tool-supporting insert board, the insert board having a tool-contact side and an image side opposite the tool contact side; and images of the tools, tool numbers and text formed on the image side of the insert board, the images, tool numbers and text being visible at the tool-contact side of the insert board, and the insert board being oriented in the box so that the image side of the insert board contacts an underside of the box and the tool-contact side faces upwardly and away from the underside of the box so that tools placed in the box contact the tool-contact side of the insert board.

2. The tool storage system of claim 1 wherein the insert board is translucent.

3. The tool storage system of claim 1 wherein the insert board is transparent.

4. The tool storage system of claim 1 wherein the images, tool numbers and text are printed.

5. The tool storage system of claim 1 wherein the insert board is adhesively attached in the box.

6. The tool storage system of claim 2 wherein the insert board is laser scribed with the images, tool numbers and text.

7. An insert for a tool storage box consisting of:

a transparent tool-supporting sheet of polycarbonate having a tool-contact side and an image side opposite the tool-contact side, the image side being a contact side for an underside of the tool storage box;

tool holding devices attached to the tool-contact side of the sheet of polycarbonate, and wherein images of tools, tool numbers and text are disposed on the image side and are viewable from the tool-contact side.

* * * * *